United States Patent [19]

Hrenyo

[11] Patent Number: 5,018,623

[45] Date of Patent: May 28, 1991

[54] MOLDED PLASTIC OVERWRAP TRAY

[75] Inventor: John Hrenyo, Washington, N.J.

[73] Assignee: Tekni-Plex Inc., Brooklyn, N.Y.

[21] Appl. No.: 492,889

[22] Filed: Mar. 12, 1990

[51] Int. Cl.[5] ..... B65D 1/34; B65D 6/04; B65D 71/08

[52] U.S. Cl. ..... 206/557; 206/497; 220/902

[58] Field of Search ..... 206/557, 497, 518; 220/902, 659

[56] References Cited

U.S. PATENT DOCUMENTS

| | | | |
|---|---|---|---|
| 2,918,379 | 12/1959 | Lurie | 206/557 |
| 2,975,931 | 3/1961 | Harrison | 206/497 X |
| 3,185,371 | 5/1965 | Reifers | D9/425 |
| 3,411,265 | 11/1968 | Carpenter, et al | 206/497X |
| 3,420,431 | 1/1969 | Donovan | 206/557 X |
| 3,468,468 | 9/1969 | Foote | 220/902 |
| 3,922,362 | 11/1975 | Pierce | 206/497 X |
| 4,869,362 | 9/1989 | Herr | 206/557 X |

*Primary Examiner*—William I. Price
*Attorney, Agent, or Firm*—McAulay Fisher Nissen Goldberg & Kiel

[57] ABSTRACT

A molded plastic overwrap tray is disclosed having a base and sidewalls. The sidewalls are outwardly bowed and connected to one another through integrally formed radius corners. A thick, wide bead is integrally formed to the sidewalls adjacent the open end tray to form a lip for the tray. A plurality of reinforcing ribs also are integrally formed in the corner or junctures connecting the sidewalls to the base. The tray is adapted to be sealed with a tightly stretched overwrap film which exerts compressive forces to provide the tray with relatively straight or slightly bowed upper side edges.

11 Claims, 2 Drawing Sheets

MOLDED PLASTIC OVERWRAP TRAY

BACKGROUND OF THE INVENTION

I. Field of the Invention

This invention relates generally to a molded plastic overwrap tray, and in particular, to overwrap trays used in the poultry processing industry.

II. Description of the Prior Art

Molded plastic overwrap trays are commonly used in the poultry processing industry. These trays are made of polystyrene foam and serve as packaging for cuts of poultry which trays are then sealed with an overwrap of transparent film.

The trays generally are of rectangular shape and are made in a variety of sizes by thermoforming machinery which is well known in the art. It has become increasingly evident that there is a tendency for such machinery to stretch or wrap the transparent film so tightly as to distort the trays. That is, the tightly wrapped film tends to bow the sidewalls of the tray inwardly to an extent which results in cracking or breaking of the trays, particularly if the polystyrene foam is brittle. The cracking or breaking of the trays necessitates costly removal of the poultry, downtime on the packaging machine, and repackaging as well as discarding of the original packaging.

The present invention improves on the heretofore known trays by a construction which is intended to minimize tray breakage, repackaging costs, and objectionable inward bowing of the sidewalls in the manner hereinafter described.

SUMMARY OF THE INVENTION

The invention provides for a plastic tray having a base and four sidewalls. Each of the sidewalls is outwardly bowed, and adjacent sidewalls are connected to one another through an integrally formed large radius corner. A thick, wide bead is integrally formed to the sidewalls adjacent the open end of the tray to form a lip for the tray. A plurality of reinforcing ribs also are integrally formed in the corner or junctures connecting the sidewalls to the base. The resulting structure is such that the compressive forces due to a tightly stretched overwrap film will provide the tray with relatively straight or slightly outwardly bowed side upper edges.

Additional features and advantages of the present invention will become more apparent from a consideration of the following detailed description when taken in conjunction with the accompanying drawings.

DESCRIPTION OF THE PREFERRED EMBODIMENT

Figure 1:
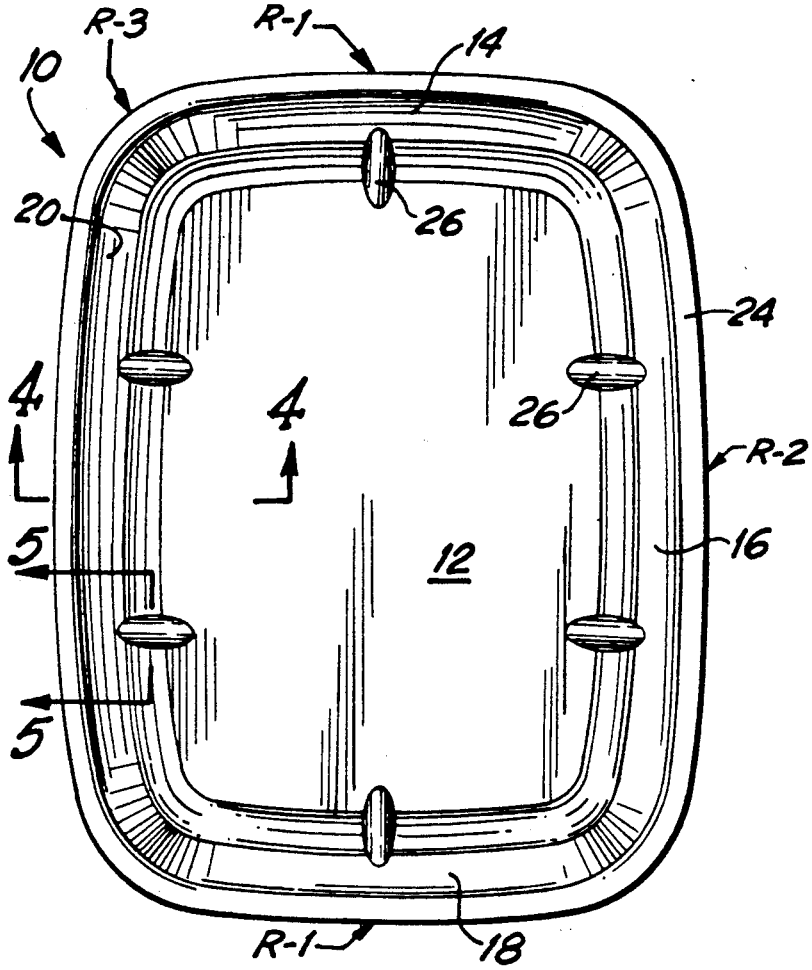
FIG. 1 is a top plan view of the plastic tray constructed in accordance with the present invention.
Figure 2:
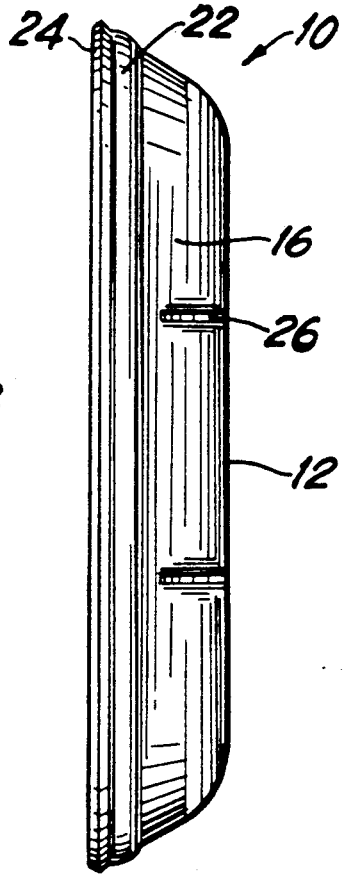
FIG. 2 is a right side elevational view thereof.
Figure 4:
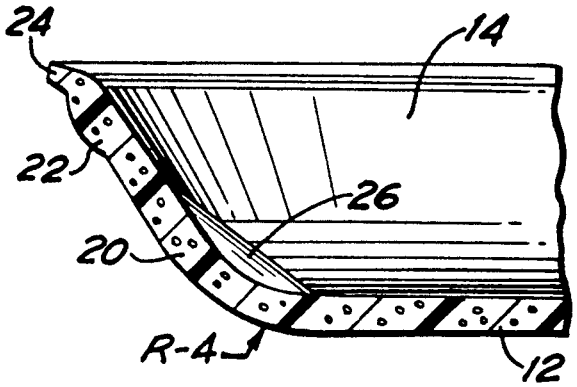
FIG. 4 is a sectional view taken along line 4—4 of FIG. 1.
Figure 5:
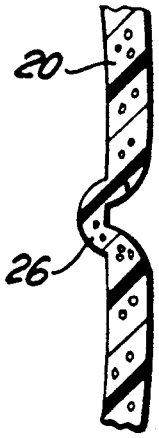
FIG. 5 is a sectional view taken along line 5—5 of FIG. 1.
Figure 3:
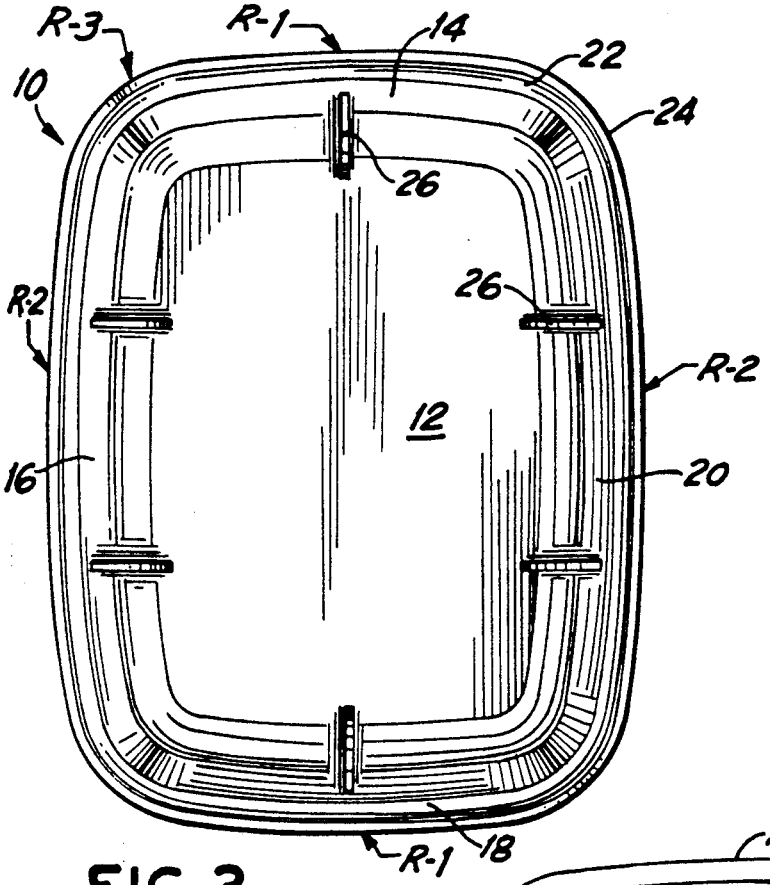
FIG. 3 is a bottom plan view thereof.

Referring to the drawings, numeral 10 represents a plastic tray constructed in accordance with the present invention. Tray 10 is preferably molded of polystyrene foam utilizing thermoforming machinery and techniques well known in the art. The use of such material provides a tray that has a certain degree of stiffness or rigidity, but which is yet sufficiently resilient and flexible for its intended use.

Tray 10 includes a base 12 and four sidewalls 14, 16, 18 and 20 integrally joined together to form a packaging tray. Each of the sidewalls 14–20 is outwardly bowed and includes an integrally formed thickened, wide bead 22 adjacent the open end of tray 10 to form a lip 24 for the tray. Bead 22 serves to stiffen lip 24 to resist crack formation.

Also, integrally formed in the corner or juncture where the sidewalls 14–20 are connected to base 12, are a plurality of reinforcing ribs 26 which extend around the perimeter of the tray. In the illustrated embodiment, a single rib 26 is provided in sidewalls 14 and 18, and two of such ribs 26 are provided in each of sidewalls 16 and 20. The number of ribs selected will be a function of the overall dimensions of the tray, and the placement thereof generally will be to divide the length dimension and the width dimension into equal segments. Ribs 26 serve to resist the bending that normally takes place between sidewalls 14–20 and base 12 during film overwrapping. Reinforcement in this area or region reduces sidewall deflection and helps to retain the shape of tray 10 as hereinafter described.

The thicknesses of base 12 and sidewalls 14–20 are approximately 0.220 inches. The thickness of ribs 26 is approximately 0.125 inches. The thickness of bead 22 is approximately 0.250 inches.

Tray 10 can be made of varying sizes. For example, the length may extend in a range from about 8.655 inches to 11.750 inches. The width may extend in a range from about 6.375 inches to 9.125 inches. The depth dimension may extend in a range from 1.188 inches to 1.313 inches.

The shape of tray 10 may be defined by expressing the curvature of sidewalls 14–20 in terms of a radius of curvature. For example, the radius of curvature of opposed sidewalls 14 and 18, represented by letter R-1, may extend in a range from about 10.188 inches to 12.750 inches. The radius of curvature of opposed sidewalls 16 and 20, represented by letter R-2, may extend in a range from about 18.313 inches to 20.500 inches.

The radius corner between adjacent sidewalls, represented by letter R-3, may extend in a range from about 1.750 inches to 2.250 inches. The radius corner between sidewalls 14–20 and base 12, represented by letter R-4, is approximately 0.750 inches.

Figure 6:
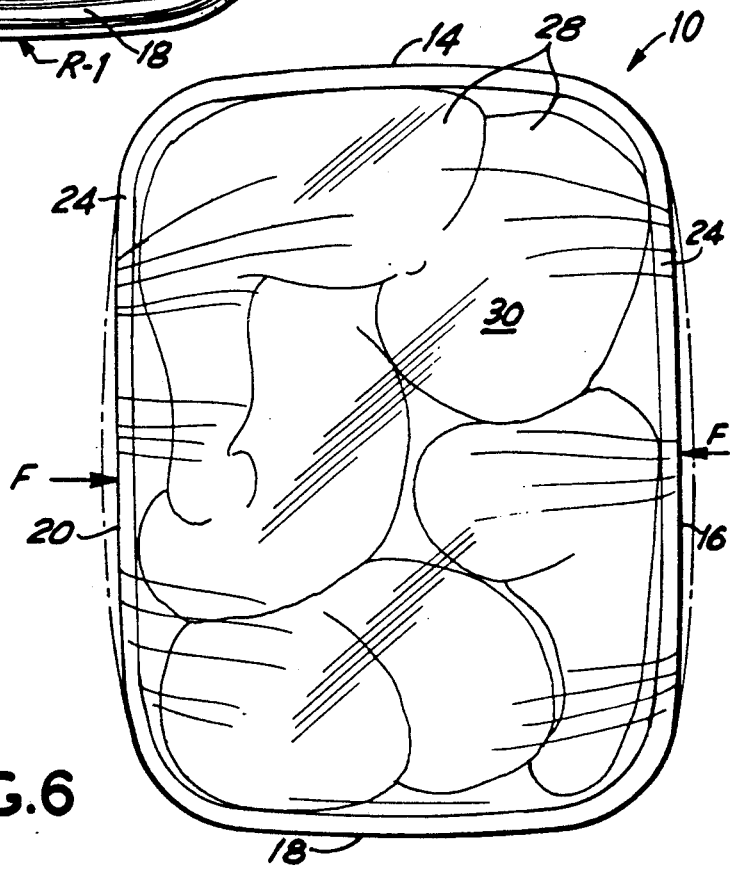
FIG. 6 is a view similar to FIG. 1 with the tray containing cuts of poultry and sealed with an overwrap of transparent film.

FIG. 6 shows tray 10 filled with poultry parts 28 and sealed with a tightly stretched overwrap transparent film 30. The compressive forces resulting from the stretched overwrap film, represented by the arrows "F" in FIG. 6, provide the packaged tray with relatively straight or slightly outwardly bowed side upper edges. For example, and for purpose of comparison, the dotted lines of sidewalls 16 and 20 represent the position of such sidewalls prior to packaging, whereas the solid lines denote the position due to the compressive forces resulting from the stretched overwrap film. This is in sharp contrast to the heretofore known trays wherein inward bowing of the sidewalls resulted in cracking and breaking of the trays.

The large radius corner R-3 of tray 10 between adjacent sidewalls provide an arch type support which serves to distribute the compression forces from the tightly stretched overwrap film 30 more uniformly. The outwardly bowed sidewalls similarly function to distribute such compression forces more uniformly. The large radius corner R-4 of tray 10 between the sidewalls and the base reduces the likelihood of stretching the foam material and thinning of the sidewalls during the thermoforming operation. All of the above improved features contribute to a tray construction which minimizes breakage and is aesthetically pleasing in appearance.

While a preferred embodiment of the invention has been shown and described in detail, it will be readily understood and appreciated that numerous omissions, changes, and additions may be made without departing from the spirit and scope of the invention.

I claim:

1. A molded plastic overwrap tray comprising:

a base and four sidewalls, each of said sidewalls having an upper edge;

adjacent sidewalls being connected to one another through an integrally formed large radius corner;

said sidewalls having an integrally formed thick, wide bead located adjacent to the open end of the tray to form a lip for said tray; and said sidewalls being outwardly bowed by an amount which responds to the compressive forces imposed by a tightly stretched overwrap film to provide the tray with sidewalls having relatively straight or slightly bowed upper edges.

2. A molded plastic overwrap tray comprising:

a base and four sidewalls, each of said sidewalls having an upper edge;

adjacent sidewalls being connected to one another through an integrally formed large radius corner having a radius of curvature from about 1.750 inches to 2.250 inches; and said sidewalls being outwardly bowed by an amount which responds to the compressive forces imposed by a tightly stretched overwrap film to provide the tray with sidewalls having relatively straight or slightly bowed upper edges.

3. A molded plastic overwrap tray comprising:

a base and four sidewalls, each of said sidewalls having an upper edge;

said sidewalls being joined to said base by an integrally formed relatively large radius corner having a radius of curvature of about 0.750 inches;

adjacent sidewalls being connected to one another through an integrally formed large radius corner; and said sidewalls being outwardly bowed by an amount which responds to the compressive forces imposed by a tightly stretched overwrap film to provide the tray with sidewalls having relatively straight or slightly bowed upper edges.

4. The overwrap tray of claim 3, further comprising a plurality of reinforcing ribs integrally formed in said corner connecting said base to said sidewalls.

5. A molded plastic overwrap tray comprising:

a base and four sidewalls, each of said sidewalls having an upper edge;

said sidewalls being joined to said base by an integrally formed relatively large radius corner, said corner having a plurality of reinforcing ribs integrally formed therein;

adjacent sidewalls being connected to one another through an integrally formed large radius corner;

said sidewalls having an integrally formed thick, wide bead located adjacent to the open end of the tray to form a lip for said tray; and said sidewalls being outwardly bowed by an amount which responds to the compressive forces imposed by a tightly stretched overwrap film to provide the tray with sidewalls having relatively straight or slightly bowed upper edges.

6. The overwrap tray of claim 1, wherein said large radius corner between sidewalls has a radius of curvature from about 1.750 inches to 2.250 inches.

7. The overwrap tray of claim 1, wherein said sidewalls are joined to said base by an integrally formed relatively large radius corner having a radius of curvature of about 0.750 inches.

8. The overwrap tray of claim 6, wherein said sidewalls are joined to said base by an integrally formed relatively large radius corner having a radius of curvature of about 0.750 inches.

9. The overwrap tray of claim 5, wherein said large radius corner between sidewalls has a radius of curvature from about 1.750 inches to 2.250 inches.

10. The overwrap tray of claim 5, wherein said sidewalls are joined to said base by an integrally formed relatively large radius corner having a radius of curvature of about 0.750 inches.

11. The overwrap tray of claim 9, wherein said sidewalls are joined to said base by an integrally formed relatively large radius corner having a radius of curvature of about 0.750 inches.

* * * * *

US005018623B1

REEXAMINATION CERTIFICATE (3505th)

United States Patent [19] [11] B1 5,018,623

Hrenyo [45] Certificate Issued May 5, 1998

[54] MOLDED PLASTIC OVERWRAP TRAY

[75] Inventor: John Hrenyo, Washington, N.J.

[73] Assignee: Tekni-Plex, Inc., Somerville, N.J.

Reexamination Request:
No. 90/004,559, Feb. 21, 1997

Reexamination Certificate for:

| | |
|---|---|
| Patent No.: | **5,018,623** |
| Issued: | **May 28, 1991** |
| Appl. No.: | **492,889** |
| Filed: | **Mar. 12, 1990** |

[51] Int. Cl.[6] ..... B65D 1/34; B65D 6/04; B65D 71/08

[52] U.S. Cl. ..... 206/557; 206/497; 220/902; 229/407

[58] Field of Search ..... 229/406, 407

[56] References Cited

U.S. PATENT DOCUMENTS

| | | | |
|---|---|---|---|
| D. 174,831 | 5/1955 | Nowak . | |
| D. 280,296 | 8/1985 | Holden . | |
| D. 280,297 | 8/1985 | Holden . | |
| D. 304,684 | 11/1989 | Hadtke . | |
| D. 304,685 | 11/1989 | Hadtke . | |
| D. 305,732 | 1/1990 | Hadtke . | |
| 2,918,379 | 12/1959 | Lurie | 206/557 |
| 2,975,931 | 3/1961 | Harrison | 206/497 |
| 3,185,371 | 5/1965 | Reifers . | |
| 3,411,265 | 11/1968 | Carpenter et al. | 206/497 |
| 3,420,431 | 1/1969 | Donovan | 206/557 |
| 3,468,468 | 9/1969 | Foote | 220/902 |
| 3,700,096 | 10/1972 | Reifers | 229/407 |
| 3,761,011 | 9/1973 | Reifers et al. | 229/407 |
| 3,922,362 | 11/1975 | Pierce | 206/497 |
| 4,061,241 | 12/1977 | Retelny . | |
| 4,349,146 | 9/1982 | Holden | 229/407 |
| 4,623,088 | 11/1986 | Holden | 229/407 |
| 4,856,704 | 8/1989 | Tolson et al. . | |
| 4,869,362 | 9/1989 | Herr | 206/557 |
| 5,050,791 | 9/1991 | Bowden et al. | 229/407 |

OTHER PUBLICATIONS

A drawing of a bead design used by Tekni-Plex, Inc. prior to Mar., 1990.

*Primary Examiner*—Gary E. Elkins

[57] ABSTRACT

A molded plastic overwrap tray is disclosed having a base and sidewalls. The sidewalls are outwardly bowed and connected to one another through integrally formed radius corners. A thick, wide bead is integrally formed to the sidewalls adjacent the open end tray to form a lip for the tray. A plurality of reinforcing ribs also are integrally formed in the corner or junctures connecting the sidewalls to the base. The tray is adapted to be sealed with a tightly stretched overwrap film which exerts compressive forces to provide the tray with relatively straight or slightly bowed upper side edges.

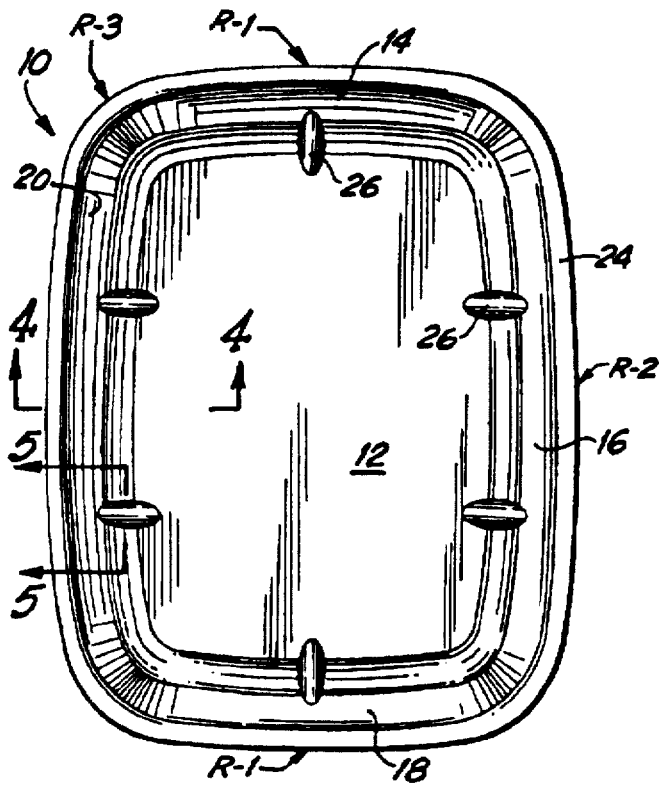

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2–4 and 6–11 is confirmed.

Claims 1 and 5 are cancelled.

New claims 12, 13 and 14 are added and determined to be patentable.

*12. A molded plastic tray intended to serve as packaging for a food product, and which tray is then intended to be sealed with an overwrap of tightly stretched transparent film, said tray comprising:*

*a one piece body of foamed plastic polymer having a base and four sidewalls, at least two of said sidewalls defining an opposed pair of sidewalls;*

*each of said sidewalls having an upper edge and being joined to said base by an integrally formed large radius corner;*

*each of said sidewalls being joined to an adjacent sidewall by an integrally formed large radius corner having a radius of curvature from about 1.750 inches to 2.250 inches;*

*a plurality of reinforcing ribs integrally formed with and connecting each of said opposed pair of sidewalls with said base;*

*a thick, wide bead integrally formed in each of said opposed pair of sidewalls adjacent to their respective upper edges to strengthen the upper edges of said sidewalls and to form a lip for said tray; and*

*each of said opposed pair of sidewalls being outwardly bowed by an amount which responds to the compressive forces imposed by the tightly stretched overwrap film, with the upper edges of each of said outwardly bowed opposed sidewalls being relatively straight when the overwrap film is tightly wrapped about the tray.*

*13. A molded plastic tray intended to serve as packaging for a food product, and which tray is then intended to be sealed with an overwrap of tightly stretched transparent film, said tray comprising:*

*a one piece body of foamed plastic polymer having a base and four sidewalls, at least two of said sidewalls defining an opposed pair of sidewalls;*

*each of said sidewalls having an upper edge and being joined to said base by an integrally formed large radius corner having a radius of curvature of about 0.750 inches;*

*each of said sidewalls being joined to an adjacent sidewall by an integrally formed large radius corner;*

*a plurality of reinforcing ribs integrally formed with and connecting each of said opposed pair of sidewalls with said base;*

*a thick, wide bead integrally formed in each of said opposed pair of sidewalls adjacent to their respective upper edges to strengthen the upper edges of said sidewalls and to form a lip for said tray; and*

*each of said opposed pair of sidewalls being outwardly bowed by an amount which responds to the compressive forces imposed by the tightly stretched overwrap film, with the upper edges of each of said outwardly bowed opposed sidewalls being relatively straight when the overwrap film is tightly wrapped about the tray.*

*14. A molded plastic tray intended to serve as packaging for a food product, and which tray is then intended to be sealed with an overwrap of tightly stretched transparent film, said tray comprising:*

*a one piece body of foamed plastic polymer having a base and four sidewalls, said sidewalls defining a generally rectangular shape with two sidewalls defining longitudinal sides of said tray and two sidewalls defining ends of said tray, the length of said longitudinal sides being greater than the length of said ends;*

*said sidewalls having an upper edge;*

*adjacent sidewalls being joined to one another through an integrally formed large radius corner having a radius of curvature from about 1.750 inches to 2.250 inches;*

*said sidewalls having an integrally formed thick, wide bead located adjacent to the open end of the tray;*

*a lip extending from and being formed by said bead; and*

*said sidewalls being outwardly bowed by an amount which responds to the compressive forces imposed by the tightly stretched overwrap film to provide the tray with sidewalls having relatively straight or slightly bowed upper edges, wherein the radius of curvature of the bow of said longitudinal sides being greater than the radius of curvature of the bow of said ends.*

* * * * *